US005836645A

United States Patent [19]

Sakaue et al.

[11] Patent Number: 5,836,645

[45] Date of Patent: Nov. 17, 1998

[54] LOUNGER-TYPE MASSAGE MACHINE

[75] Inventors: Hironobu Sakaue; Ryuji Yamada; Haruo Sugai; Akihide Sugawa; Masamichi Miyaguchi; Masatoshi Dairin; Makoto Fukutani; Fumihiro Nishio; Hiroyuki Hojyo, all of Osaka, Japan

[73] Assignee: Matsushita Electric Works, Ltd., Osaka, Japan

[21] Appl. No.: 752,561

[22] Filed: Nov. 21, 1996

[30] Foreign Application Priority Data

Nov. 24, 1995 [JP] Japan ..... 7-305912

[51] Int. Cl.[6] ..... A47C 1/02

[52] U.S. Cl. ..... 297/68; 297/85; 297/219.1; 297/440.14; 297/452.38; 601/86; 601/57; 601/56; 601/59; 5/653

[58] Field of Search ..... 297/68, 85, 89, 297/219.1, 452.38, 440.23, 224, 228, 228.11, 228.12, 228.13, 440.14, 411.24, 411.27; 601/49, 86, 56, 57, 58, 59, 115, 128, 131, 134; 5/653, 485, 632, 630

[56] References Cited

U.S. PATENT DOCUMENTS

| | | | |
|---|---|---|---|
| 27,645 | 3/1860 | McGregor . | |
| 2,808,827 | 10/1957 | O'Hara | 601/86 X |
| 2,891,538 | 6/1959 | Moxley | 601/56 |
| 2,937,641 | 5/1960 | Oetinger | 601/59 |
| 3,092,100 | 6/1963 | Oetinger | 601/57 |
| 3,446,204 | 5/1969 | Murphy | 601/57 |
| 3,678,923 | 7/1972 | Oetinger | 601/57 X |
| 4,212,496 | 7/1980 | Kirkham, Jr. | 297/219.1 X |
| 4,523,787 | 6/1985 | Robinson | 297/452.38 X |
| 4,570,996 | 2/1986 | Rogers, Jr. | 297/68 X |
| 4,602,817 | 7/1986 | Raftery | 297/440.14 X |
| 4,915,444 | 4/1990 | Rogers, Jr. | 297/68 |
| 5,120,107 | 6/1992 | Rogers, Jr. | 297/68 |
| 5,192,113 | 3/1993 | Wiecek | 297/68 X |
| 5,288,126 | 2/1994 | Saul et al. | 297/85 |
| 5,639,145 | 6/1997 | Alderman | 5/653 X |
| 5,667,832 | 9/1997 | Stevens et al. | 297/68 X |

*Primary Examiner*—Jose V. Chen
*Assistant Examiner*—Rodney B. White
*Attorney, Agent, or Firm*—Sughrue, Mion, Zinn, Macpeak & Seas PLLC

[57] ABSTRACT

In a lounger-type massage machine, a back support is reclinable relative to a seat. There is provided a leg rest which is movable between a retracted position where the leg rest is retracted to be held below the seat and a projected position where the leg rest is extended outwardly in front of the seat. A sheet is extended to cover the seat and the leg rest. There is provided a looseness prevention mechanism which pulls an end of the sheet inwardly so as to prevent the loosening of the sheet in both the retracted position and the projected position of the leg rest.

14 Claims, 23 Drawing Sheets

LOUNGER-TYPE MASSAGE MACHINE

BACKGROUND OF THE INVENTION

1. Field of the Invention

This invention relates to a reclining-type, lounger-type (chair-type) massage machine having a leg rest.

2. Related Art

FIG. 24 shows a conventional lounger-type massage machine 3 having a back support 2 which is reclinable relative to a seat 1, and a leg rest 4. In this lounger-type massage machine 3, the user sits down on the seat 1, with his back reclined against the back support 2, and in this condition the machine 3 massages the user. At this time, the shoulders, the lower back and so on of the upper half of the body are massaged by massage units (not shown) provided in the back support 2. By operating a lever, the leg rest 4 is turned or pivotally moved (see FIG. 26) from a retracted position (see FIG. 25) (where the leg rest 4 is held generally vertically below the front portion of the seat 1) to a projected position (see FIG. 24) where the leg rest 4 is projected forwardly of the seat 1, and the user puts his legs on the thus forwardly-projected leg rest 4. A motor and associated parts are incorporated in the leg rest 4, and the calves and other parts of the leg are massaged by vibrations produced by this mechanism.

As will be appreciated from FIG. 24, when the leg rest 4 is extended outwardly in front of the seat 1, a gap of about several centimeters is formed between the seat 1 and the leg rest 4. A child may put his leg into this gap, or the hand or the arm may be caught in this gap, which is dangerous. Therefore, in the conventional construction, this gap is covered by a cloth, 60. When the leg rest 4 is retracted to be held below the front portion of the seat 1, that portion of the cloth 60, which covers the gap between the seat 1 and the leg rest 4 when the leg rest 4 is projected forwardly of the seat 1, is folded to be received in the gap between the seat 1 and the leg rest 4, as shown in FIG. 26.

However, in order that the cloth 60, which covers the gap between the seat 1 and the leg rest 4 when the leg rest 4 is extended outwardly in front of the seat 1, can be faded to be satisfactorily received in the gap between the seat 1 and the leg rest 4 when the leg rest 4 is retracted to be held below the front portion of the seat 1, the cloth 60 must be relatively thin. Thus, the leg rest 4 and the seat 1 are interconnected by the relatively thin cloth 60, and therefore a profound and high-quality impression is not obtained from the viewpoint of the design, and besides when the leg rest 4 is projected forwardly, the seat 1 and the leg rest: 4 do not appear to be integral with each other, which detracts from the commercial value.

Particularly, since the above massage machine 3 with the reclining mechanism is of the lounger type, this massage machine is used as a mere lounger or chair more frequently than as the massage lounger, and therefore the massage machine 3 needs to have a good design and a high-grade appearance as a lounger or a piece of furniture. In this respect, the relatively thin cloth 60, used to conceal the gap between the leg rest 4 and the seat 1, has a problem that it does not provide the required design and appearance grade as a lounger or a piece of furniture.

The lounger-type massage machine 3 with the reclining mechanism, when flawed or stained at its surface, must be repaired so that it can retain the appearance grade as a piece of furniture. In such a case, a covering material on the surface must be entirely exchanged in the conventional construction. And besides, the reclining mechanism and the massage mechanism must be periodically supplied with grease, oil or the like, and also must be repaired if necessary. This maintenance and inspection are troublesome in the conventional construction.

The degree of stiffness of the shoulders, as well as the desired intensity of massaging, differs from one person to another, and there are those who want a strong massage and also those who want a soft massage. Further, even the same person may want a strong massage one day, and a weak massage another day. In the conventional construction, the intensity of massaging has been adjusted only by switching the massaging operation by the massage unit. Furthermore, since the lounger-type massage machine 3 is used as a lounger more frequently than as a massage machine, and when the massage machine 3 is used as a lounger, and arms and massage balls of the massage units are in contact with the body of the user, so that the user can not feel relaxed.

In the conventional construction, a power switch 11 for turning on and off a power source is mounted on a side surface of the back support 2 as shown in FIG. 27. When the power switch 11 is thus provided on the side surface of the back support 2, there is a possibility that the elbow contacts the power switch 11, thereby causing an erroneous operation. Therefore, as shown in FIG. 27, a recess 61 is formed in the side surface of the back support 2, and the power switch 11 is provided in this recess 61. In this construction, however, there has been encountered a problem that the operability is poor since the power switch 11 is provided in the narrow recess 61.

SUMMARY OF THE INVENTION

The present invention has been made in view of the above problems of the conventional construction, and an object of the invention is to provide a construction in which a gap between a leg rest and a seat is concealed, and besides when the leg rest is in either of a position where the leg rest is retracted below a front portion of the seat and a position where the leg rest is extended outwardly (i.e., projected forwardly) in front of the seal, the seat and the leg rest appear to be integral with each other, with n separating line formed therebetween. Another object of the present invention is to provide a lounger-type massage machine which can be easily maintained, inspected, and repaired; which allows facilitated selection of a desired massage intensity; which has arms and massage balls of the massage units disposed inside the machine that do not interfere with the seated person's comfort when the machine is used only as a lounger; and which has a power switch that can not be inadvertently operated by accidentally coming into contact with a person's elbow.

The above problems of the conventional construction have been solved by a lounger-type massage machine of the present invention wherein a back support is reclinable relative to a seat, wherein there is provided a leg rest which is movable between a retracted position where the leg rest is retracted to be held below the seat and a projected position where the leg rest is extended outwardly in front of the seat; a sheet is extended to cover the seat and the leg rest; and there is provided looseness prevention mechanism which pulls an end of the sheet inwardly so as to prevent looseness of the sheet both in the retracted position and the projected position of the leg rest. With this construction, both in the retracted position and the projected position of the leg rest, the gap between the leg rest and the seat is covered by the sheet without loosening the sheet.

According to the present invention, armrests are removably mounted on a reclining device, and a side plate is removably attached to a side of each of the armrests. With this construction, if a covering on the side plate on the outer side of the armrest is damaged, only the side plate is removed, and the damaged covering can be replaced by a new one, thus effecting the repair. In the maintenance and inspection, by removing the armrest, an internal mechanism can be easily exposed so that the maintenance and inspection can be effected.

According to the present invention, a back cover can be attached to the back support, and pads can be removably stored in a central portion of the back cover. With this arrangement, there can be selected one of the cases where the back cover is not used, where the back cover is attached to the back support, with no pad used, and where the back cover is attached to the back support, and one or more of the pads, having different thicknesses and different cushioning properties, are selectively attached to the back cover. By doing so, one can select the intensity of the massage. When this massage machine is used merely as a lounger without giving a massage, the contact of arms and massage balls with the body of the user can be weakened by putting one or more pads 10*a* in the back cover attached to the back support.

According to the present invention, a power-switch for turning on and off a power source is provided at a lateral side portion of a rear side of the back support. With this construction, the power switch will not be erroneously operated by the elbow of the user seated on the seat, and besides since the power switch does not need to be mounted in a narrow recess as in the conventional construction, the operability is enhanced.

According to the present invention, the seat, the back support, the armrest, the leg rest are detachably mounted on the reclining device so that the maintenance and inspection can be effected.

BRIEF DESCRIPTION OF THE DRAWINGS

FIG. 2(*b*) is a side view showing a portion where ends of rubber bands are fixedly secured to a lower surface of the leg rest;

FIG. 2(*c*) is a cross-sectional view showing another embodiment of looseness prevention mechanism;

FIG. 10(*b*) is a cross-sectional view showing an engaging mechanism of the present invention;

FIG. 18(*b*) is a front-elevational view of a power switch block;

FIG. 19(*b*) is an exploded, perspective view showing the manner of attaching a link cover;

FIG. 20(*b*) is a perspective view showing the position of the link portion in the retracted position of the leg rest;

FIG. 21(*b*) is a perspective view of the massage machine used as a lounger;

FIG. 22(*b*) is a perspective view of the massage machine, with leg rest projected;

FIG. 23(*b*) is a perspective view of the massage machine, with the leg rest projected and with the back support laid down;

DETAILED DESCRIPTION OF THE PREFERRED EMBODIMENTS

A preferred embodiment of the present invention will now be described with reference to the accompanying drawings.

Figure 1:
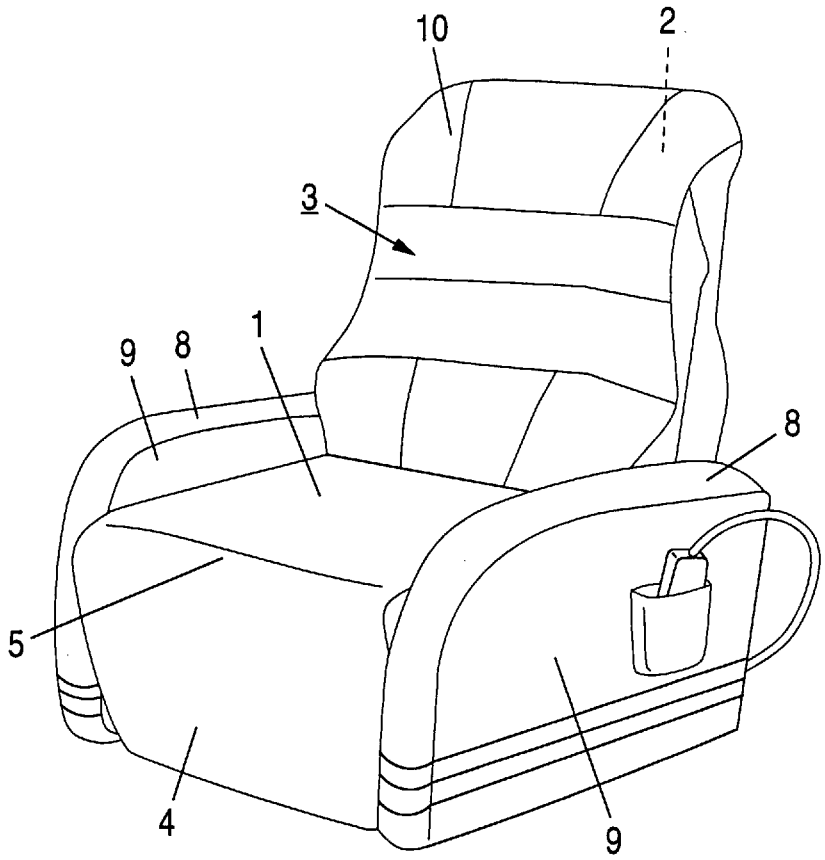
FIG. 1 is a perspective view showing the whole of a lounger-type massage machine according to a preferred embodiment of the present invention, with a leg rest held in its retracted position.
Figure 28:
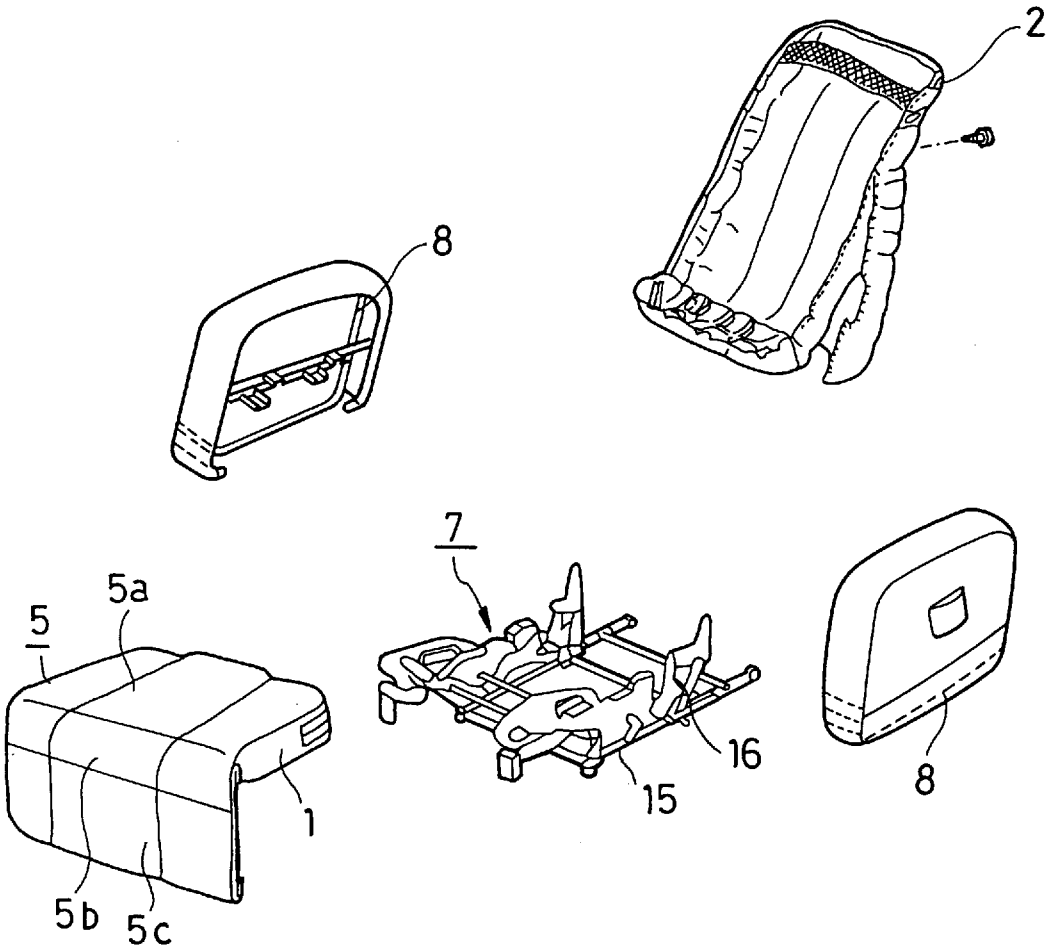
FIG. 28 is an exploded, perspective view showing the whole of the lunger-type massage machine.

FIG. 1 is a perspective view showing the whole of a lounger-type massage machine 3 according to a preferred embodiment of the invention. The lounger-type massage machine 3 of the invention comprises a seat 1, a back support 2 which is rendered reclinable relative to the seat 1 by reclining mechanisms, armrests 8 provided respectively at opposite sides of the seat 1, and a leg rest 4 provided at a front side of the seat 1. As shown in FIG. 28, the seat 1, the back support 2, the armrests 8, the leg rest 4 are detachably mounted on a reclining device 7.

Figure 4:
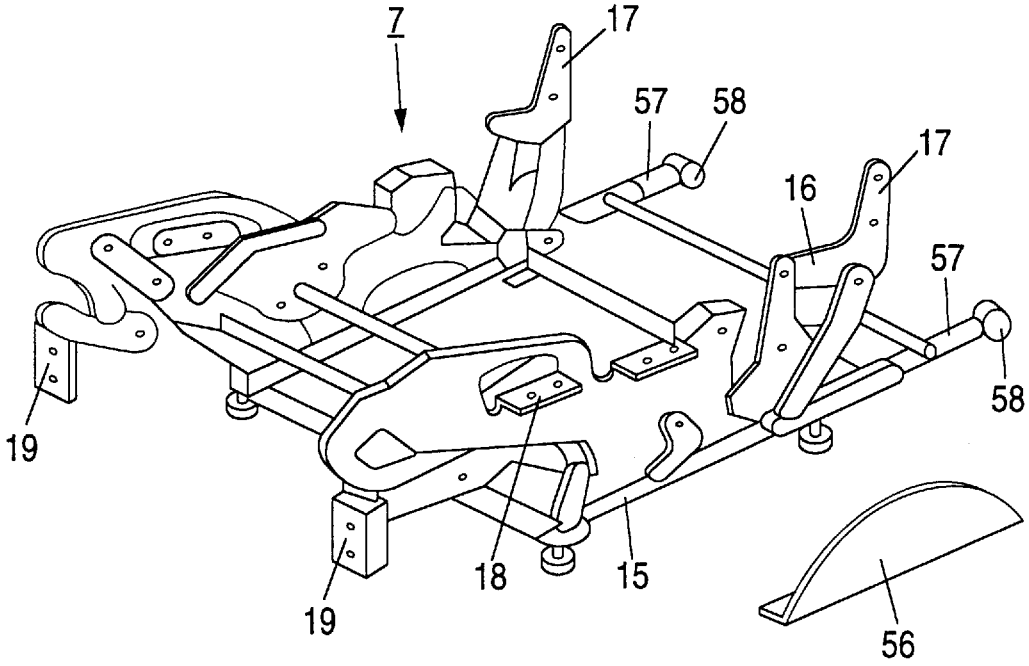
FIG. 4 is a schematic perspective view of a reclining device of the massage machine.
Figure 5:
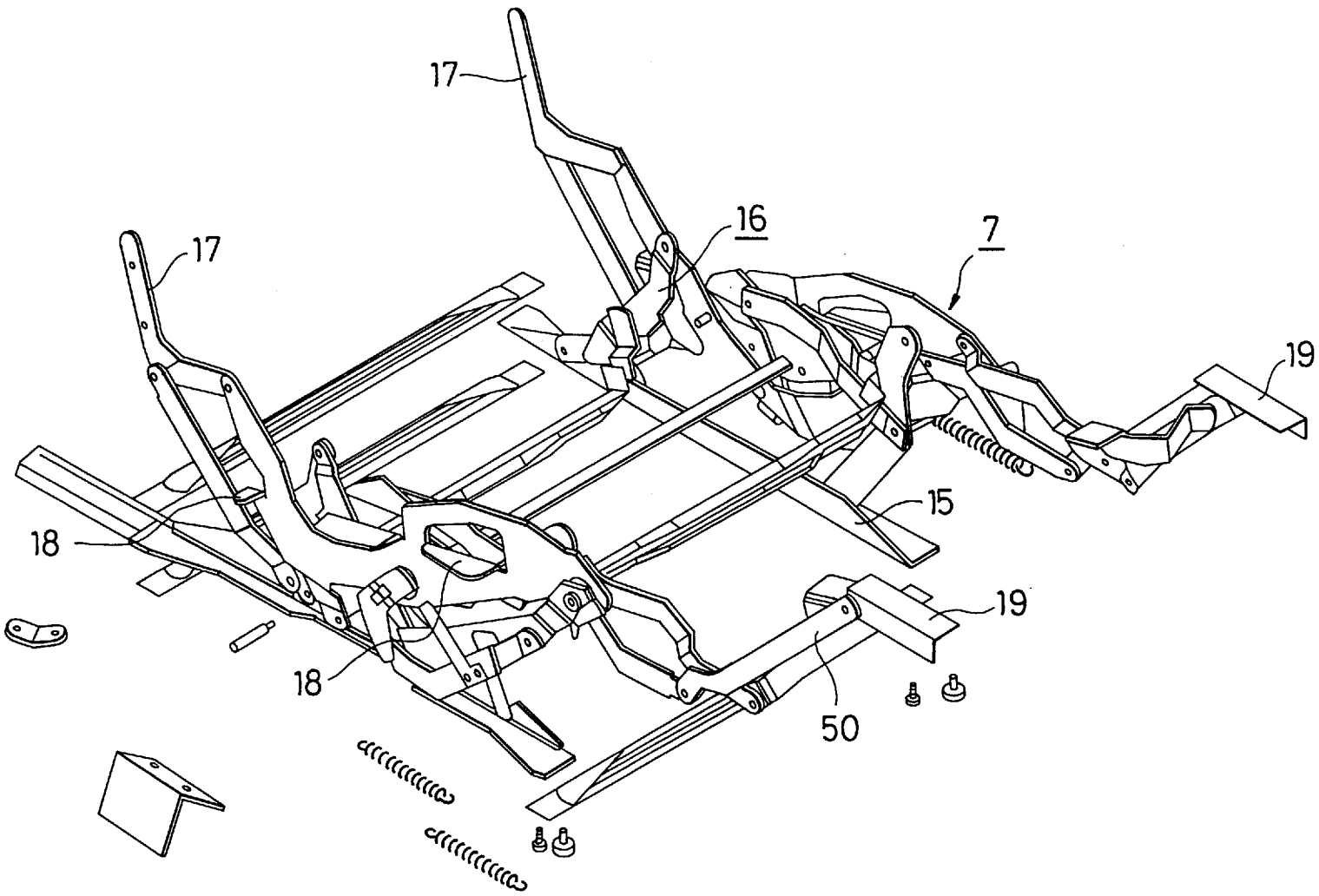
FIG. 5 is a partly-exploded, perspective view showing the reclining device.
Figure 6:
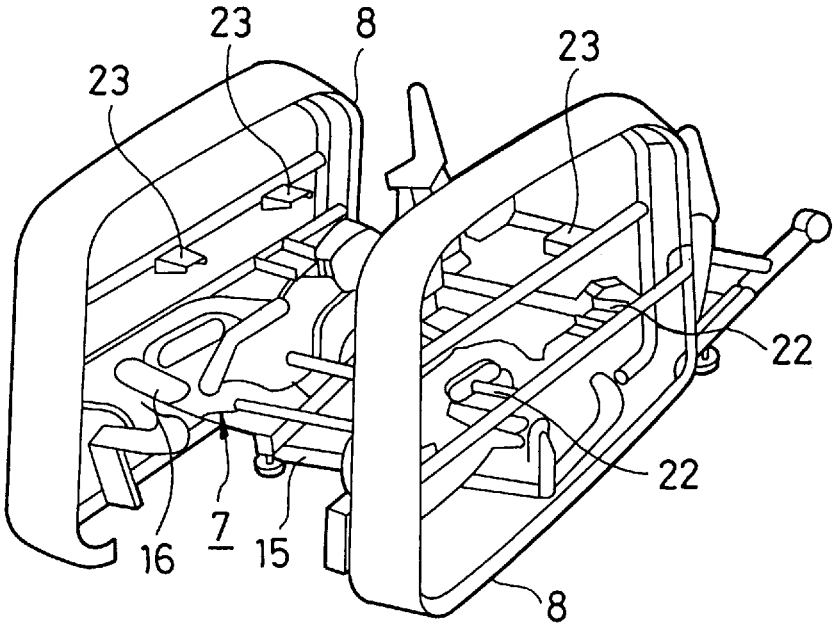
FIG. 6 is a perspective view showing the reclining device having armrests mounted thereon.

FIGS. 4 and 5 show the reclining device 7. The reclining device 7 comprises reclining mechanisms 16 mounted on a reclining base 15, each of the reclining mechanisms 16 comprising a plurality of links. Each reclining mechanism 16 includes a back support-mounting portion 17, armrest-mounting portions 18 and a leg rest-mounting portion 19. The back support 2, containing massage units (not shown) therein, is secured at its opposite sides to the back support-mounting portions 17 by screws, and the armrests 8 are removably attached respectively to the armrest-mounting portions 18 by screws, and the leg rest 4 is removably attached to the leg rest-mounting portions 19 by screws.

Figure 3:
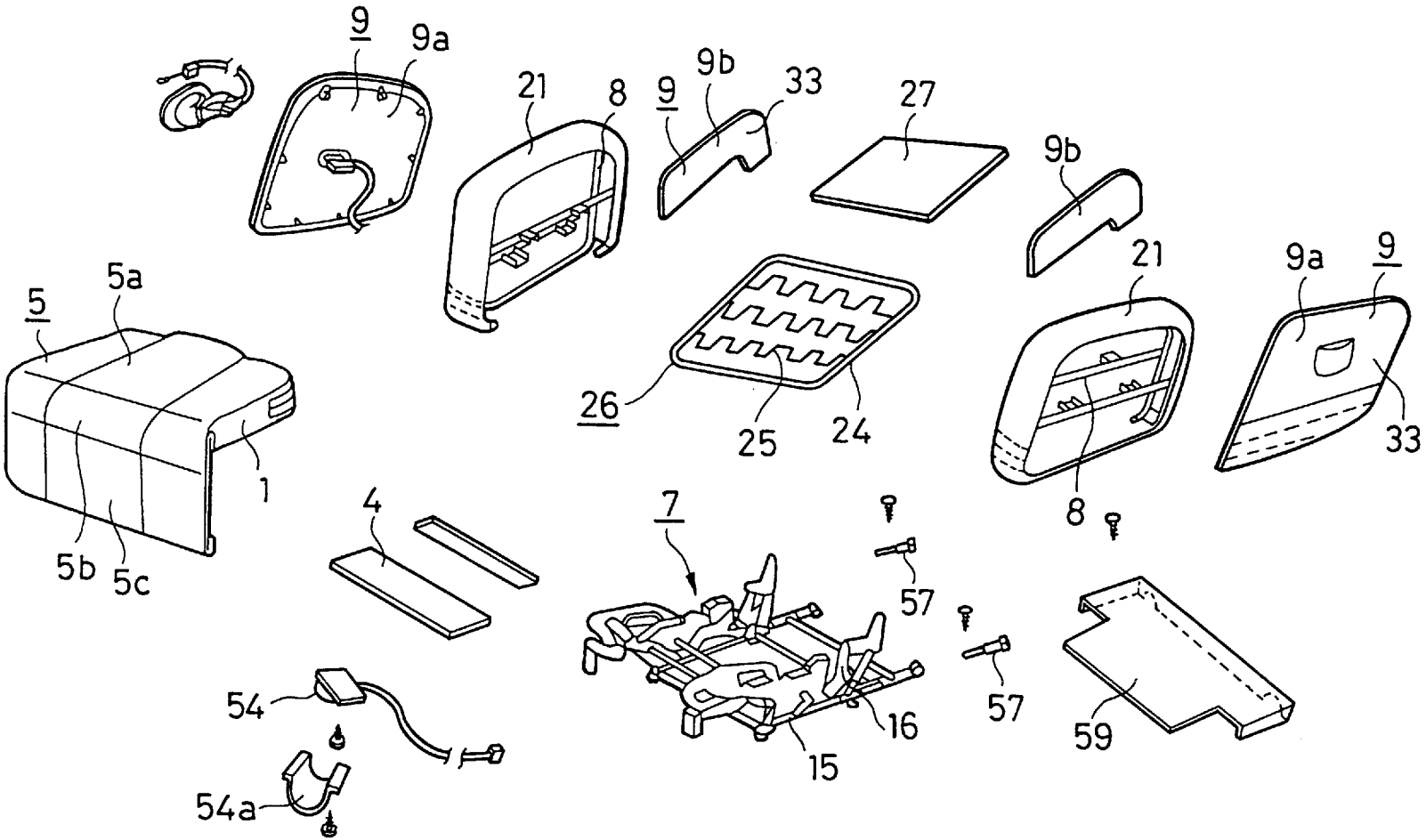
FIG. 3 is an exploded, perspective view showing the whole of the lunger-type massage machine except a back support.
Figure 7B:
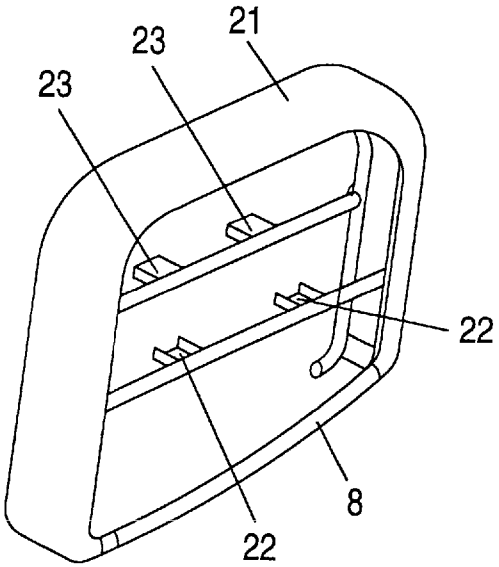
FIGS. 7(*a*) and 7(*b*) are perspective views showing the right and left armrests, respectively, each having a covering attached thereto.
Figure 7A:
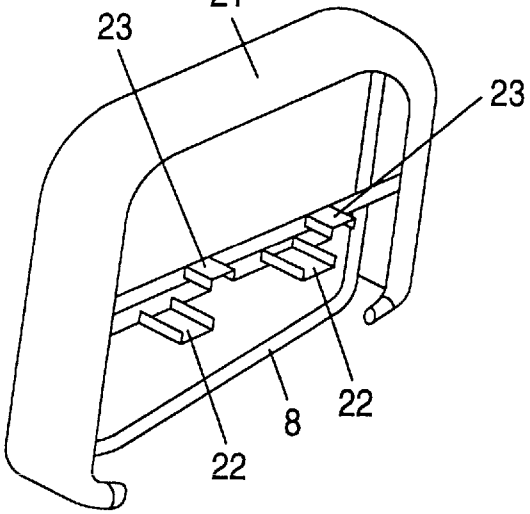
Figure 8B:
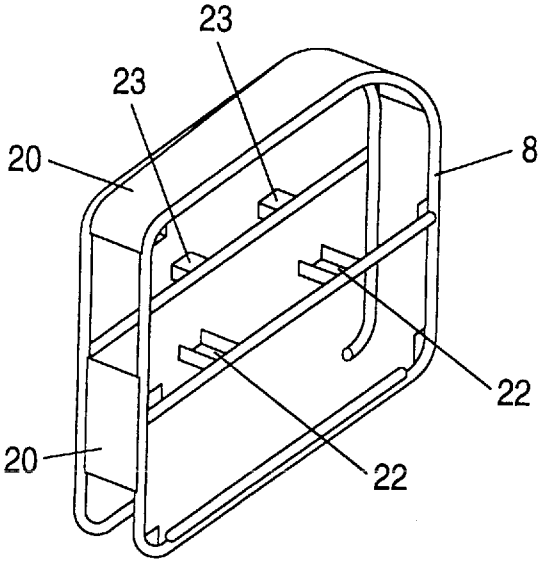
FIGS. 8(*a*) and 8(*b*) are perspective views showing the armrests.
Figure 8A:
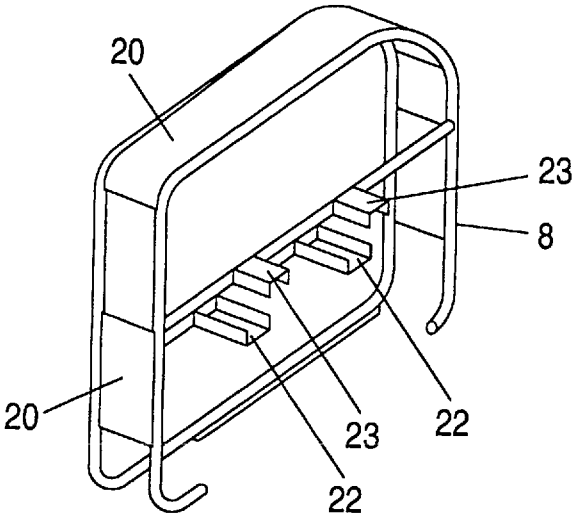

As shown in FIGS. 3, 7(*a*), 7(*b*), 8(*a*), and 8(*b*), the armrest 8 comprises a frame formed by pipes, and a plate 20 is mounted between two pipes constituting an outer peripheral portion of—the armrest 8, and a covering 21, made of leather, cloth or the like, is attached to upper, front and rear sides of this frame. Two pipes extends at an intermediate portion of the armrest 8, and are disposed at different levels, respectively. Connecting portions 22 are formed on the lower pipe, and are removably secured respectively to the armrest-mounting portions 18 of the reclining mechanism 16 by screws. Seat-mounting portions 23 are formed on the upper one of the two pipes extending at the intermediate portion of the armrest 8. An outer peripheral frame 24 of a seat bottom frame 26, having springs 25 extending between opposed sides of the outer peripheral frame 24, is removably secured to the seat-mounting portions 23 by screws. The seat 1, having cushioning properties, is placed on and fixedly secured to the seat bottom frame 26 through a bottom sheet 27.

Figure 2:
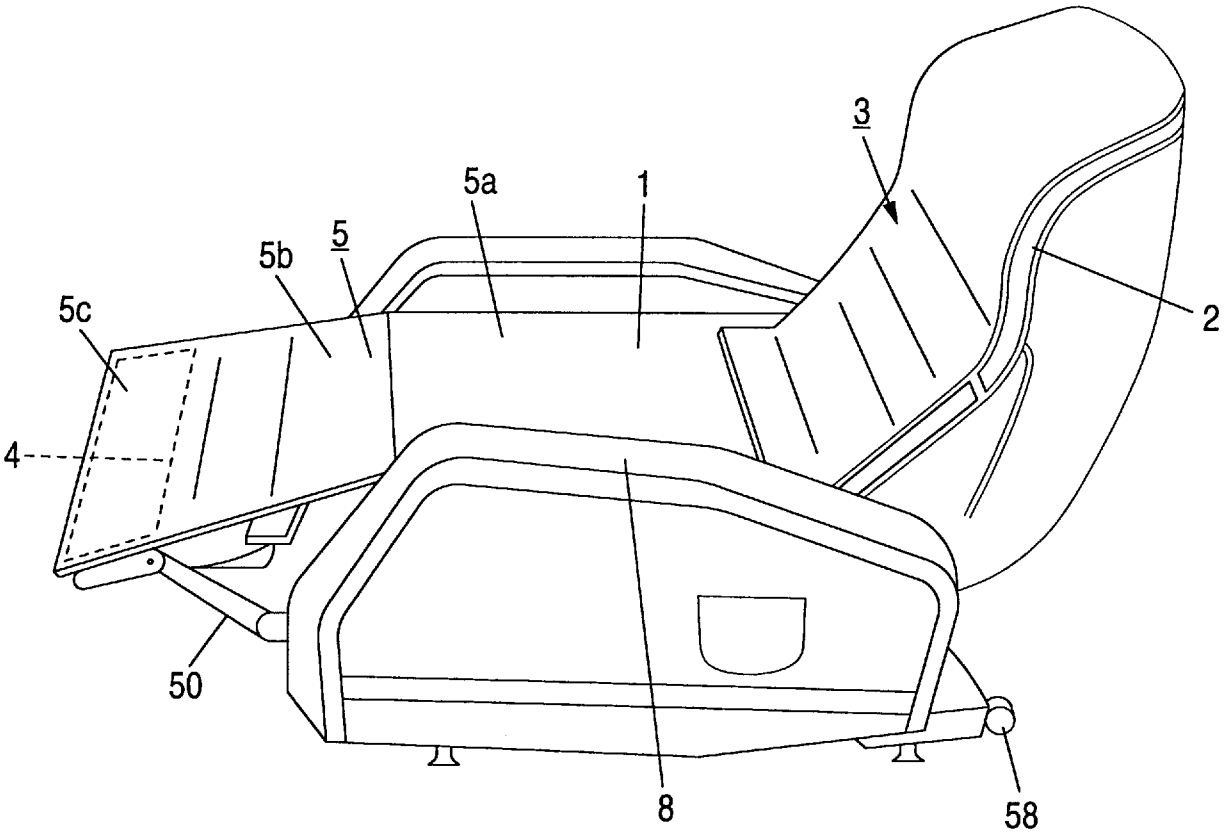
FIG. 2(*a*) is a perspective view showing the whole of the massage machine, with the leg rest extended outwardly.
Figure 2:
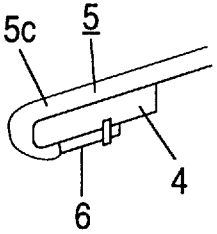
Figure 2:
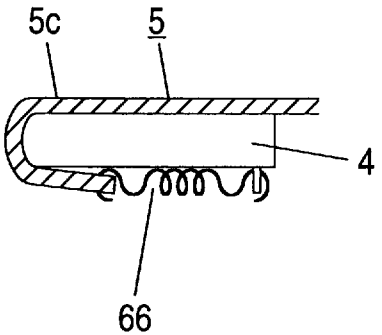
Figure 10:
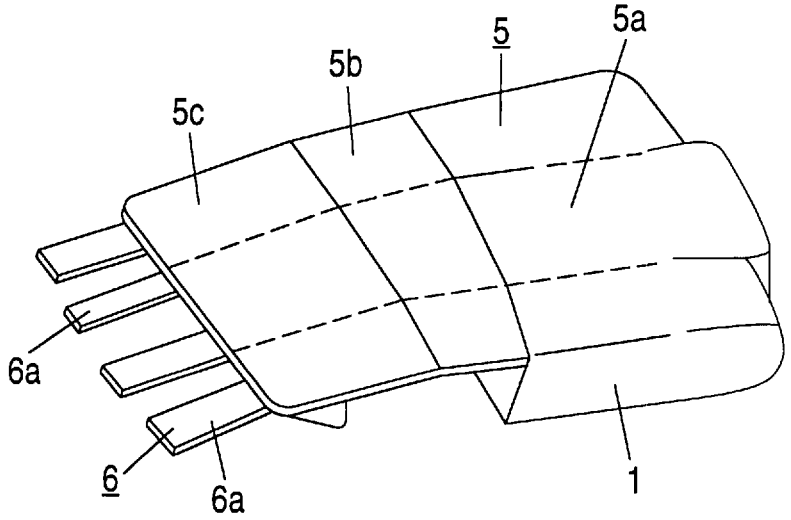
FIG. 10(*a*) is a perspective view showing a seat having a sheet attached thereto.
Figure 10:
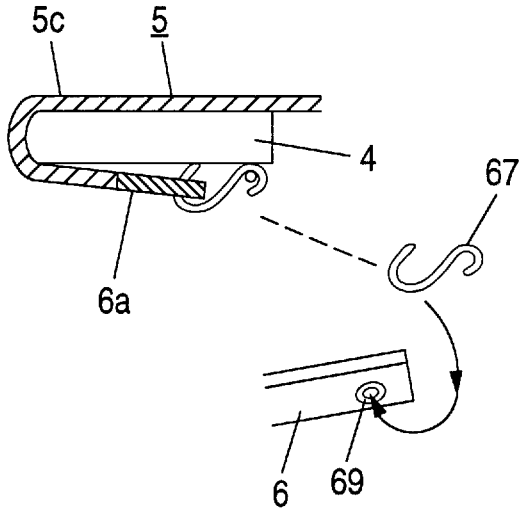

As shown in FIGS. 10(*a*) and 10(*b*), the seat 1 is covered at its outer surface with a sheet 5 of leather, cloth or the like constituting a covering, and this sheet 5 has a seat-covering sheet portion 5*a* covering the seat 1, a gap-concealing sheet portion 5*b* extending forwardly of the front side of the seat 1, and a leg rest-covering sheet Portion 5*c* extending forwardly from the gap-concealing sheet portion 5*b*. A plurality of rubber bands 6*a* are secured at their ends to a front: end of the leg rest-covering sheet portion 5*c* as shown in FIG. 2(*b*), and these rubber bands 6*a* jointly constitute looseness prevention mechanism 6 which pulls the end of the sheet 5 inwardly so as to prevent the sheet 5 from being loosened or slackened.

A leg-vibrating block 54 is mounted on a lower surface of the leg rest 4 mounted on the leg rest-mounting portions 19, and this leg-vibrating block 54 is covered with a vibration block cover 54*a*. The leg rest 4 is covered at its upper surface, opposite side surfaces and front portion with the leg rest-covering sheet portion 5*c* of the sheet 5, an(1 the front ends of the plurality of rubber bands 6*a* serving as the looseness prevention mechanism 6 are fixedly secured to the lower surface of the leg rest 4 by, for example, a pin, staple or the like. A gap between the seat 1 and the leg rest 4 is covered and concealed by the gap-concealing sheet portion 5*b* of the sheet 5, and the rubber bands 6*a* impart a pulling force to the sheet 5 so that the sheet 5 will not be loosened. Namely, through movement of link portions 50 of the reclining mechanisms 16, the leg rest 4 is movable between a position (FIG. 1) where the leg rest 4 is retracted to be held in a depending posture below the front portion of the seat 1 and a position (FIG. 2(*a*)) where the leg rest 4 is extended outwardly in front of the seat 1. In the present invention, the sheet 5 is pulled by the looseness prevention mechanism 6, and by doing so, the sheet 5 is thus pulled to be prevented from becoming loosened both in the position where the leg rest 4 is retracted to be held in a depending posture below the front portion of the seat 1 and the position where the leg rest 4 is extended outwardly in front of the seat 1.

In the reclining type, lounger-type massage machine 3 of this type, the distance between the seat 1 and the distal end of the leg rest 4, required when the user is seated on the seat 1 with the legs put on the leg rest, extended outwardly in front of the seat 1, in such a manner that necessary portions of the legs rest on the leg rest 4 in a relaxed manner (no matter how long the legs are), is longer than the distance between the floor and the seat 1, required when the user is seated on the seat i with the soles of the feet put on the floor. Therefore, in the reclining-type, lounger-type massage machine 3 of this type, when moving the leg rest 4 from the position where the leg rest 4 is retracted to be-held in a depending posture below the front portion of the seat 1 to the position where the leg rest 4 is extended outwardly in front of the seat 1, the link portions 50 of the reclining mechanisms 16 for moving the leg rest 4 do not merely turn (or pivotally move) the leg rest 4, but turn the leg rest 4 while moving or projecting the leg rest 4 extended outwardly as in the conventional construction. Thus, in the reclining-type, lounger-type massage machine 3 of this embodiment, when moving the leg rest 4 from the position where the leg rest 4 is retracted to be held in a depending posture below the front portion of the seat 1 to the position where the leg rest 4 is projected forwardly of the seat 1, the leg rest 4 is not merely turned, but is turned while being moved or projected forwardly as in the conventional construction. Therefore, when the leg rest 4 is retracted to be held below the front portion of the seat 1, the sheet 5 is more liable to be loosened. However, the sheet 5 is pulled by the rubber bands 6*a*, constituting the looseness prevention mechanism 6, so that the sheet 5 will not be loosened even if the leg rest 4 is retracted to be held below the front portion of the seat 1. Therefore, naturally, when the leg rest 4 is extended outwardly in front of the seat 1, the sheet 5 is pulled, and hence is not loose.

Thus, when the leg rest 4 is both in the position where the leg rest is retracted to be held in a depending posture below the front portion of the seat 1 and in the position where the leg rest 4 is extended outwardly in front of the seat 1, the gap between the seat 1 and the leg rest 4 is covered and concealed by the sheet 5, and also in both of the two positions, the sheet 5 is pulled by the rubber bands 6*a*, constituting the looseness prevention mechanism 6, 50 that the sheet 5 will not be loosened, and in either of the positions the seat 1 and the leg rest 4 appear to be integral with each other. In contrast to the conventional construction, the sheet, which covers the gap between the leg rest 4 and the seat 1, does not need to be folded to be received in this gap, and therefore it is not necessary to use a thin material as the sheet 5, but a thick, high quality material can be used as the sheet 5.

Figure 11:
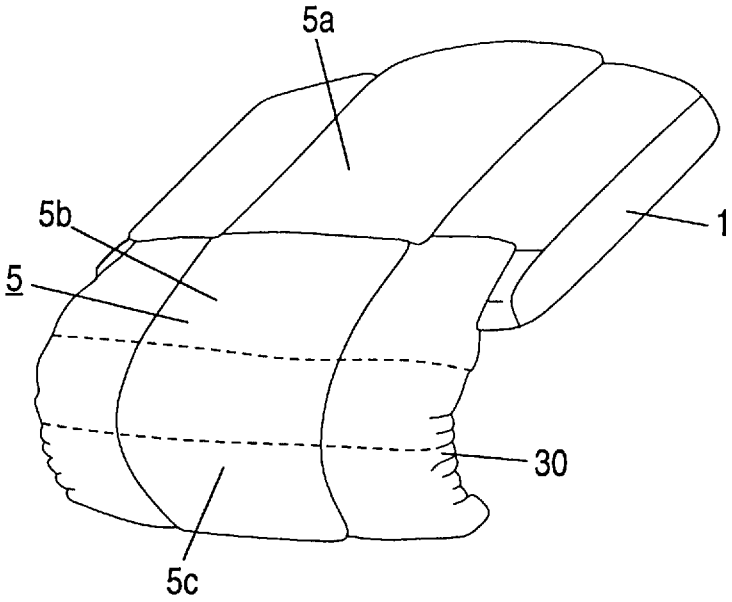
FIG. 11 is a perspective view showing a condition in which side rubber bands are secured to the sheet.
Figure 12:
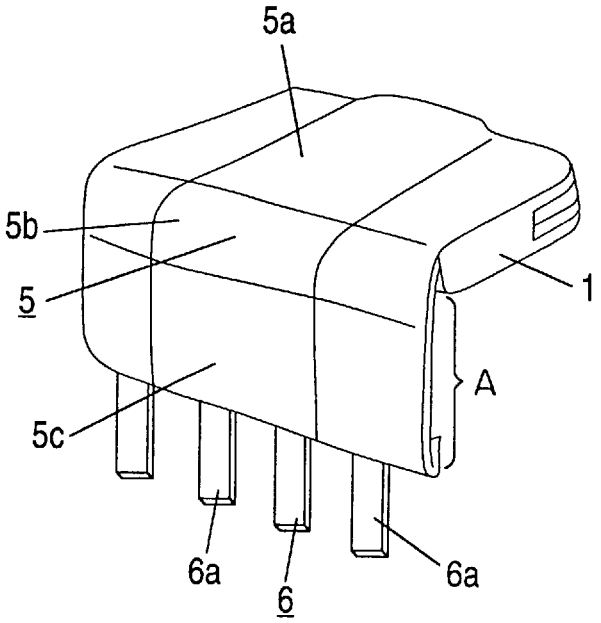
FIG. 12 is a view showing a condition in which the sheet is—loosened without the use of the side bands.

Side rubber bands are secured respectively to opposite side portions of the leg rest-covering sheet portion 5*c* (Reference numeral 30 in FIG. 11 denotes the portion where the side rubber band is provided). If the side rubber bands are not provided, each side portion of the leg rest-covering sheet portion 5*c* and the gap-concealing sheet portion 5*b*, which are indicated by A in FIG. 12, are loosened. However, by providing the side rubber bands as described above, the opposite side portions of the leg rest-covering sheet portion 5*c* and the gap concealing sheet portion 5*b* are prevented from being loosened.

Figure 13:
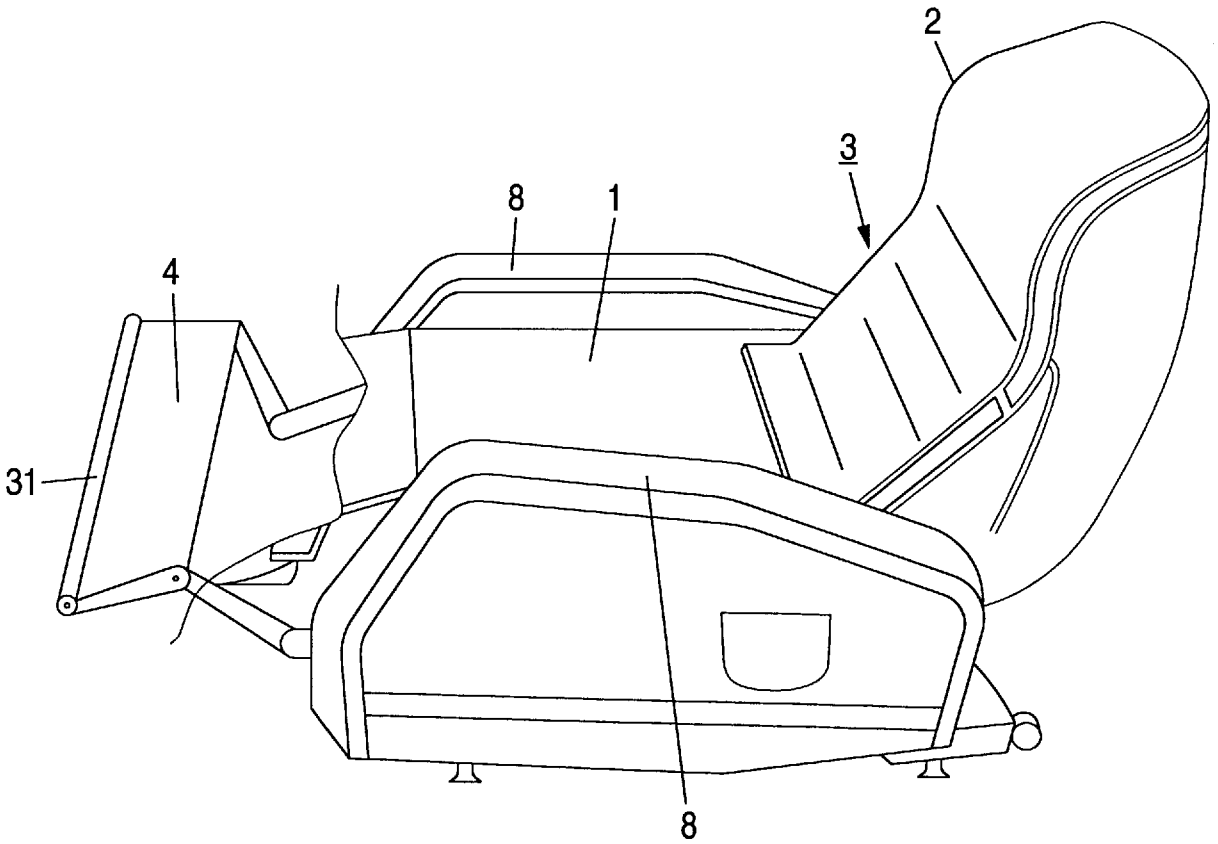
FIG. 13 is a partly-broken, perspective view showing an example in which a roller is mounted on a distal end of the leg rest.

As shown in FIG. 13, a roller 31 is rotatably mounted on the front end of the leg rest 4, and the sheet 5 is folded back around this roller 31 onto the reverse side of the leg rest 4, and the distal ends of the rubber bands 6*a*, secured to the distal end of the sheets, are fixedly secured to the lower surface of the leg rest 4. By doing so, when applying a pulling force from the rubber bands 6*a* to the sheet 5 50 as to prevent the sheet 5 from being loosened, the sheet 5 is positively pulled by the rubber bands 6*a*. Namely, when the sheet 5 is pulled by the rubber bands 6*a*, the front end portion of the leg rest 4, which usually offers the largest friction, offers the least friction because of the provision of the roller 31, and therefore the sheet 5 can be positively pulled by the rubber bands 6*a*. Of course, this invention is not limited by this embodiment. In the looseness prevention mechanism, it is applicable to use a spring 66 detachably engaged with the lower surface of the leg rest as shown in FIG. 2(*c*). Further, instead of fastening the distal ends of the looseness-prevention mechanism, it is detachably engaged with the lower surface of the leg rest by an engaging mechanism, for example, S-shape member 67 through a bar 69 as shown in FIG. 10 (*b*), a hook or the like.

Figure 9:
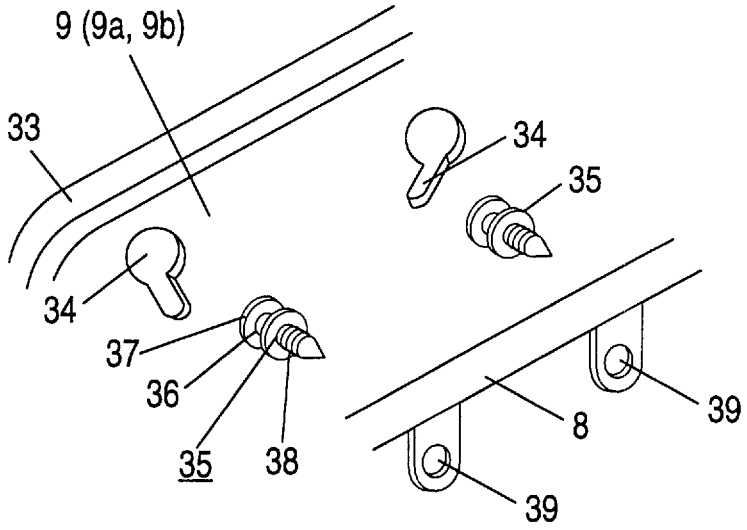
FIG. 9 is an exploded, perspective view showing the manner of attaching a side plate to the armrest.

Side plates or panels 9 are removably secured to the outer and inner sides of each armrest 8, respectively. More specifically, the outer side plate 9*a* is detachably secured to the outer side of the armrest 8, and the inner side plate 9*b* is detachably secured to the inner side of the armrest 8. The two side plates 9*a* and 9*b* are detachably secured to the armrest 8 independently of each other. One example of a method of removably attaching the side plate 9 to the armrest 8 will now be described. As shown in FIG. 9, a plurality of keyhole-shaped holes 34 are formed through the side plate 9 having a covering 33 (made of leather, cloth or the like) attached to its outer surface (The directions of smaller-hole portions of the keyhole-shaped holes 34 are different from one another). A narrow neck-like engagement portion 36 of a removable retaining element 35, molded of a synthetic resin, is fitted and engaged in the smaller-hole portion of each keyhole-shaped hole 34 through a larger-holes portion thereof (In this condition, flanges 37, provided respectively on opposite sides of the engagement portion 36, are held respectively against the outer and inner surfaces of the side plate 9, thereby preventing the retaining element 35 from withdrawal.). The removable retaining elements 35 are thus attached to the side plate 9, and in this condition a resilient, concave-convex portion 38, formed at a distal end of each removable retaining element 35, is press-fitted into an associated hole 39 formed in the armrest 8, thereby removably securing the side plate 9 to the armrest 8.

When the side plate 9 is attached to the armrest 8, the directions of the smaller-hole portions of the plurality of keyhole-shaped holes 34 are different from one another as shown in FIG. 9, and therefore the removable retaining elements 35 will not be withdrawn or disengaged from the respective keyhole-shaped holes 34. If any of the coverings 33, attached respectively to the outer side plate 9*a* or the inner side plate 9*b*, and the covering 21, attached to the armrest 8, is damaged or stained, the removable retaining elements 35 are withdrawn respectively from the holes 34 by pulling the outer side plate 9*a* or the inner side plate 9*b*, and only the damaged covering 33, 21 (attached to the outer or inner side plate 9*a* or the armrest 8) is replaced by a new one, and thus it is not necessary to exchange the entire covering.

In the maintenance, inspection, repair and so on of the reclining device 7, the side plates 9 are removed, and further the bottom seat frame 26 is removed if necessary.

Figure 14:
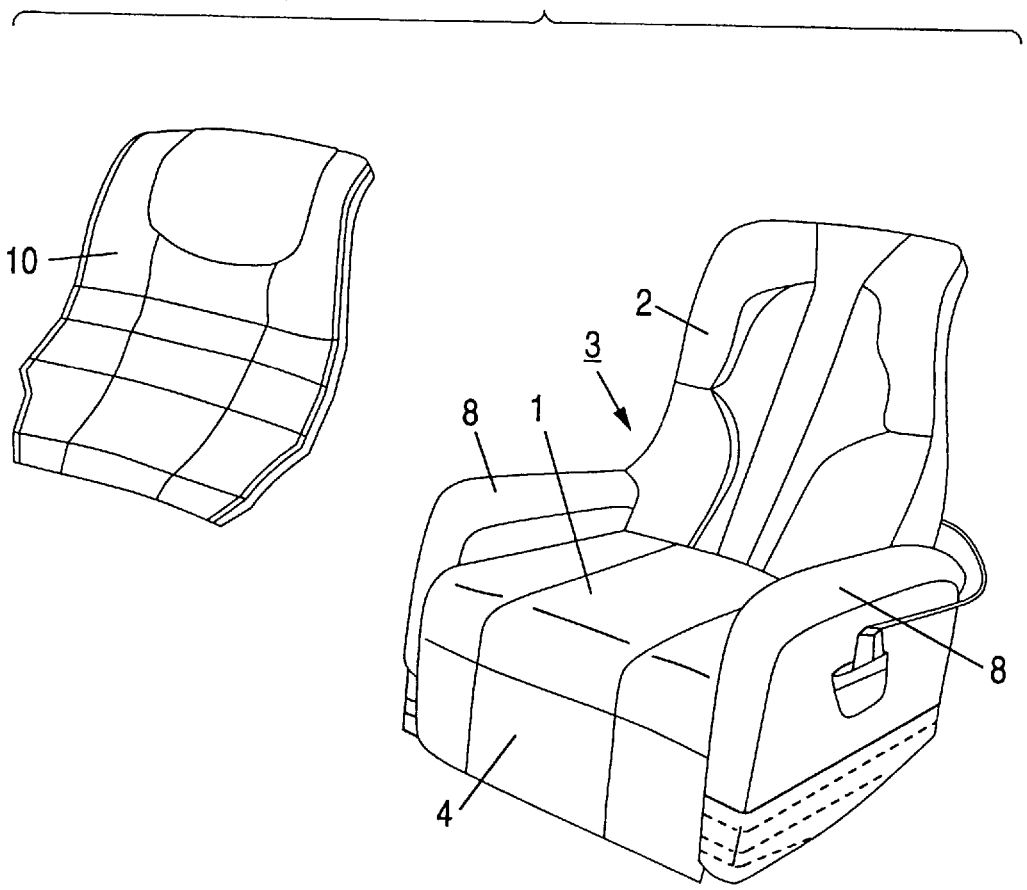
FIG. 14 is a perspective view showing a condition in which a back cover is not attached to the back support.
Figure 15:
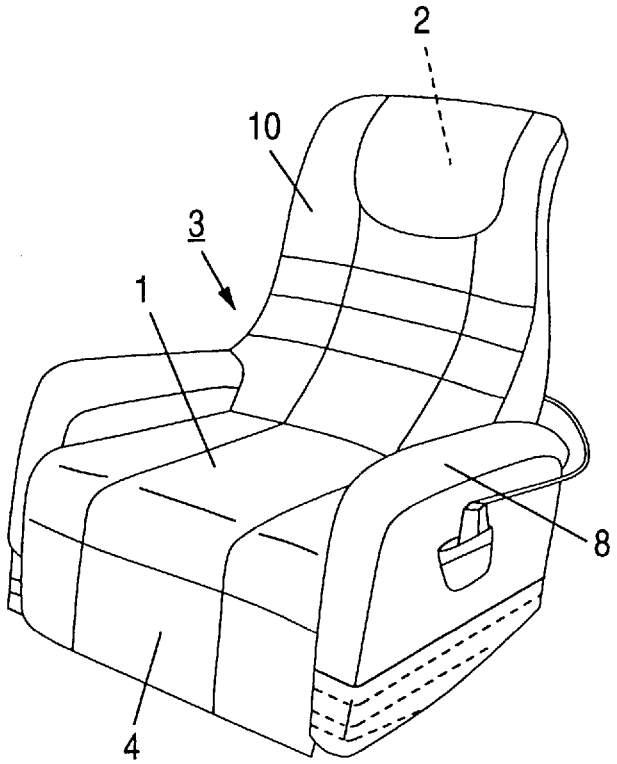
FIG. 15 is a perspective view showing a condition in which the back cover is attached to the back support.

A back cover 10 is removably attached to the back support 2 by a sliding fastener, hooks, buttons or the like. FIG. 14 shows a condition in which the back cover 10 is not attached to the back support, and FIG. 15 shows a condition in which the back cover 10 is removably attached to the back support 2 by a sliding fastener, hooks, buttons or the like.

Figure 16A:
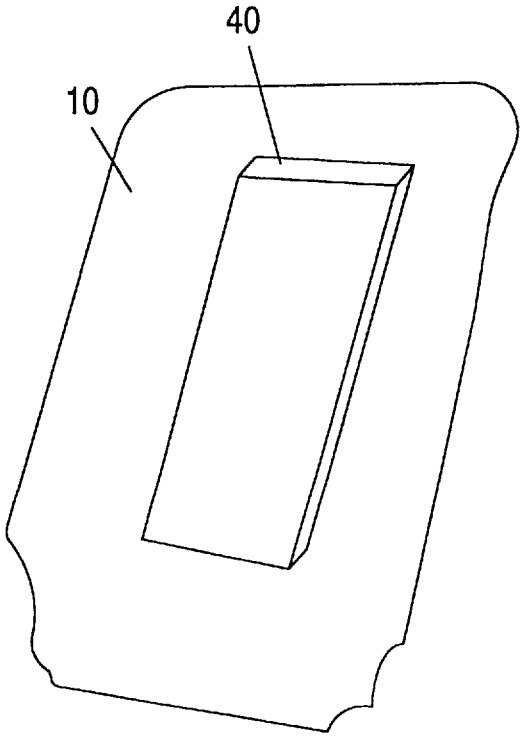
FIGS. 16(*a*) and 16(*b*) are perspective views showing a back or rear side of the back cover and pads, respectively.
Figure 16B:
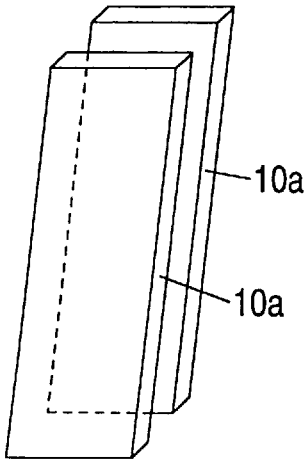

As shown in FIGS. 16(*a*) and 16(*b*), a compartment portion 40 is provided at a central portion of the back side of the back cover 10, and pads 10*a* can be stored in the compartment portion 40. The pad 10*a* comprises a cushioning material, such as a urethane foam, enclosed in an outer cover or bag. Several kinds of pads 10*a*, having different cushioning properties and different thicknesses, are prepared, and the kind of the pads, as well as the number of the pads to be stored, can be suitably selected according to the purpose. More specifically, in the condition of FIG. 14 in which the back cover 10 is not attached to the back support 2, the strongest massage can be—given to the user by the massage units contained in the back support 2. When the back cover 10 is attached to the back support 2, a softer massage can be given to the user as compared with the case where the back cover is not attached to the back support 2. And besides, even if the back cover 10 is attached to the back support, the intensity of massaging differs depending on whether or not the pads 10*a* are stored in the bag portion 40 and whether one of the pads 10*a*, having different cushioning properties and different thicknesses, is used alone or in combination with the other pads 10*a* (In the latter case, a plurality of pads 10*a* are held against one another), and with this arrangement a massage best suited for the user can be obtained. If as many pads 10*a* as possible are stored in the bag portion 40 when the lounger-type massage machine 3 is used as a mere lounger, the contact of arms and massage balls with the body of the user can be diminished.

Figure 17:
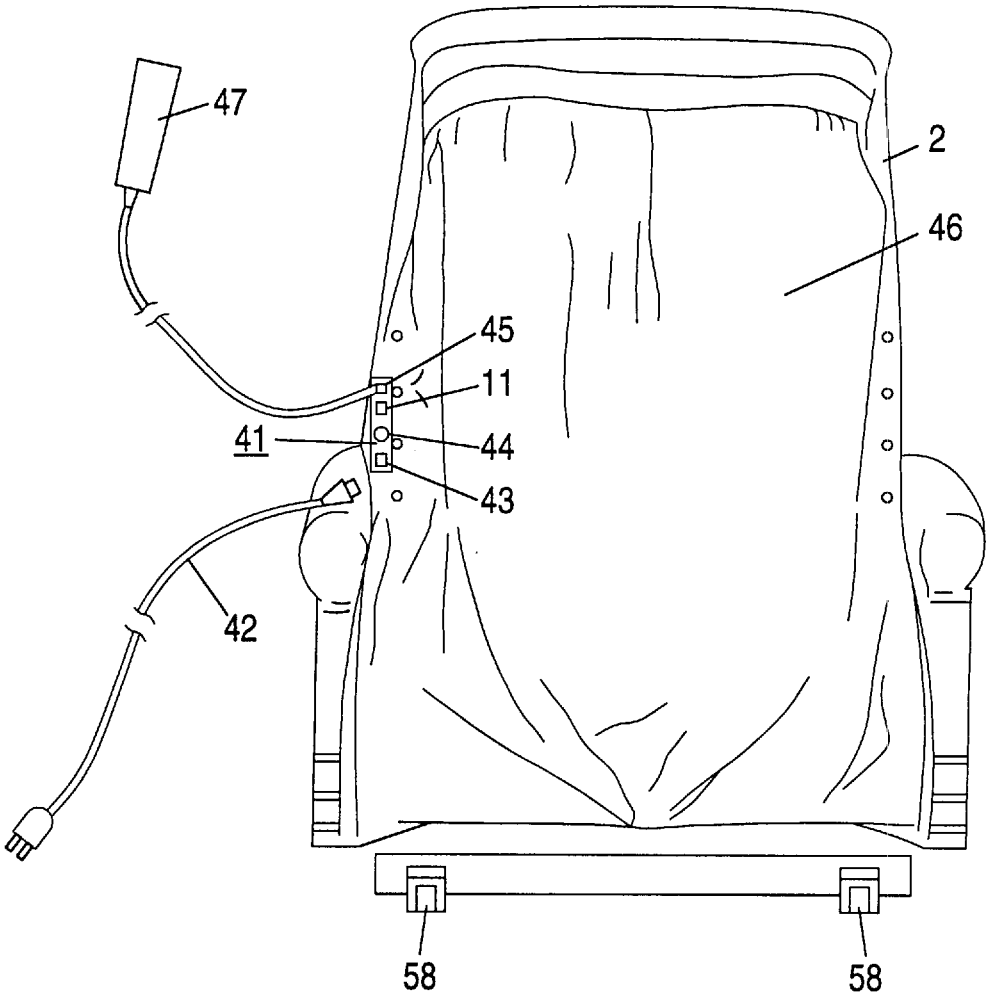
FIG. 17 is a rear view of the lounger-type massage machine.
Figure 18:
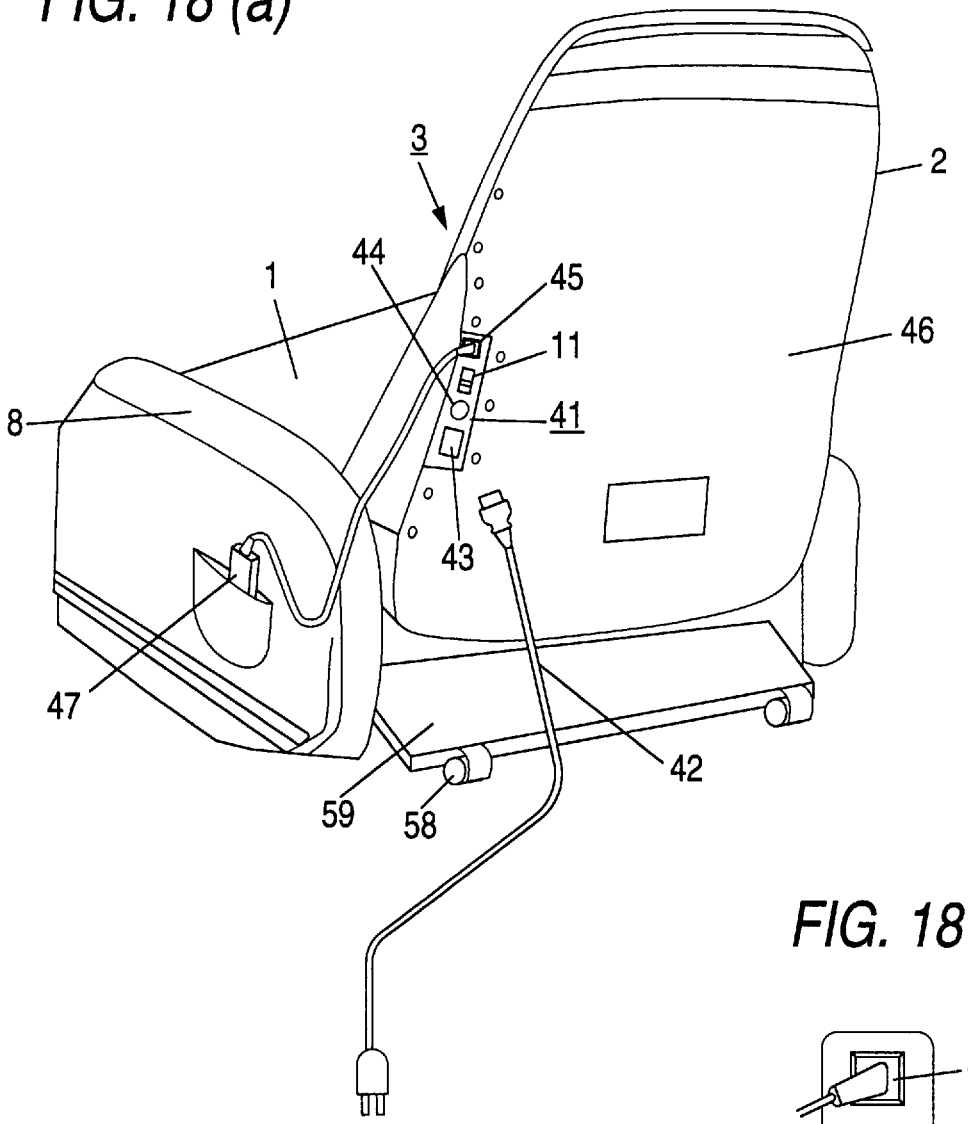
FIG. 18(*a*) is a perspective view of the lounger-type massage machine as seen from the rear side thereof.
Figure 18:
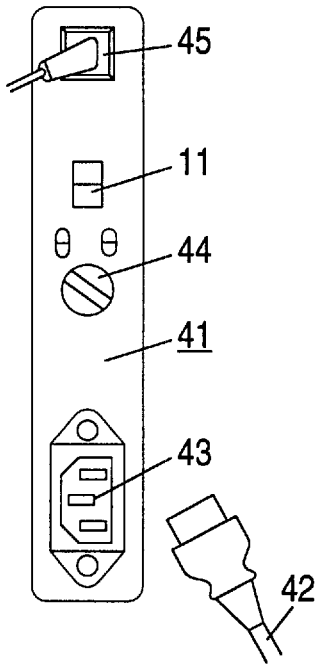

As shown in FIGS. 17, 18(*a*) and 18(*b*) a power switch block 41 is mounted on the rear or back side of the back support 2. As shown in FIG. 18(*b*), the power switch block 41 has an input portion 43 for a power cord 42, a power switch 11, a power switch lock button 44, and an operation cord-connecting portion 45. A rear cover 46 is attached to the rear side of the back support 2, and the power switch block 41 is disposed generally flush with the rear cover 46. In contrast with the conventional construction, the power switch 11 and the power switch lock button 44 are not provided on the side surface of the back support 2, and therefore the elbow of the user, seated on the seat 1, will not strike against the power switch 11 and the power switch lock button 44, and hence these will not be inadvertently operated. And besides, the conventional construction, in which the switch is provided in the narrow recess, is not needed for preventing the inadvertent operation caused by contact of the elbow, and therefore the power switch 11 and the power switch lock button 44 can be easily viewed and operated.

The user operates the power switch lock button 44 to release a locked condition, and turns on the power switch 11, and operates a switch on an operating device 47 to thereby operate the lounger-type massage machine 3. For stopping the massaging-operation, a switch on the operating device 47 is operated to stop the massaging operation. In the lounger-type massage machine 3, the massaging operation and a tapping operation are effected with a certain degree of force, and therefore if this machine is used by a child and so on, a danger may arise. Therefore, when the massage machine is not used, the power switch 11 is turned off, and the power switch lock button 44 is operated to lock the power switch 11 in its OFF-condition. In the present invention, the elbow will not strike against the power switch 11 and the power switch lock button 44 as described above, and the switch 11 and button 44 can be easily operated, and are provided at such a position that they can be easily viewed. Therefore, the turning-off of the power switch 11 and the locking operation of the power switch lock button 44 can be effected easily without forgetting.

Figure 19:
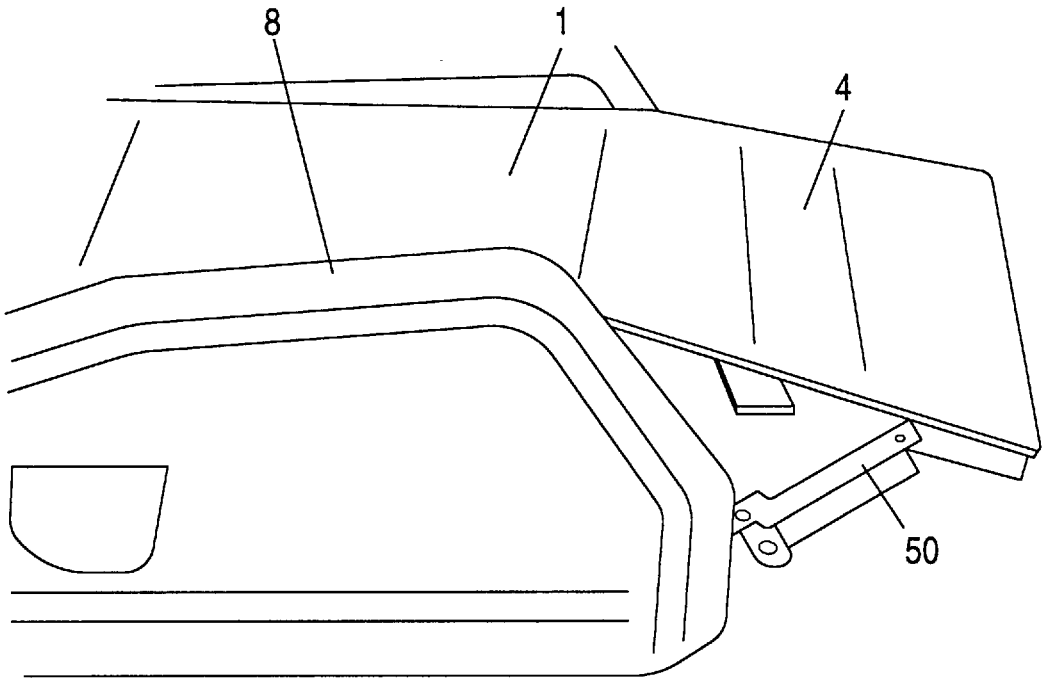
FIG. 19(*a*) is a perspective view showing a link portion for turning the leg rest.
Figure 19:
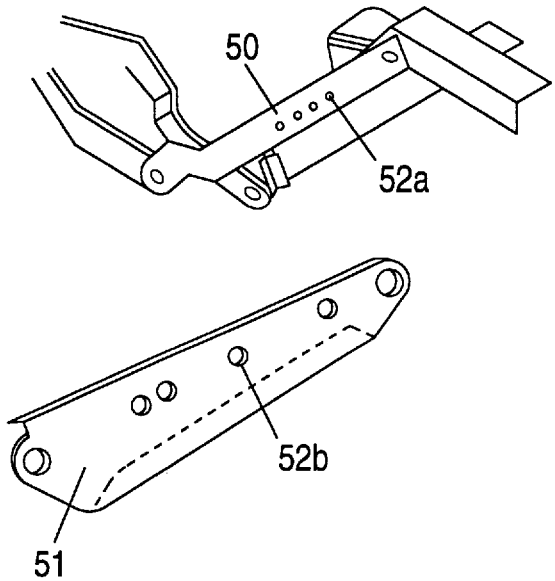
Figure 20:
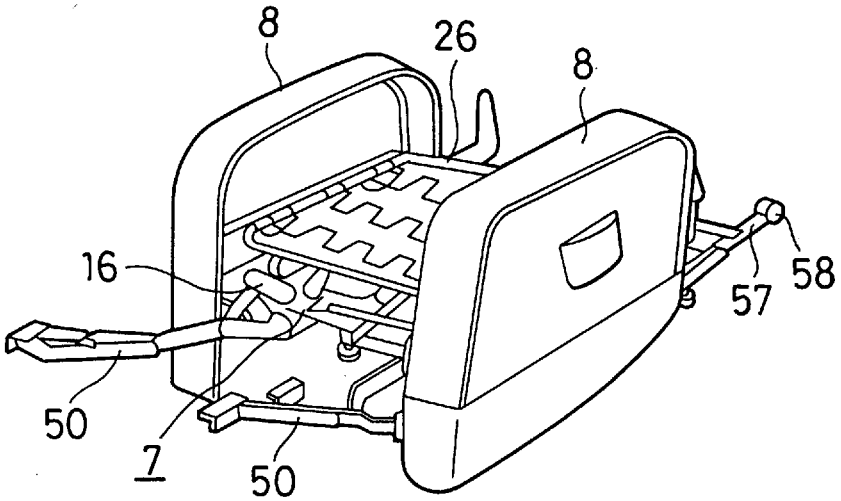
FIG. 20(*a*) is a perspective view showing t:he position of each link portion in the projected position of leg rest.
Figure 20:
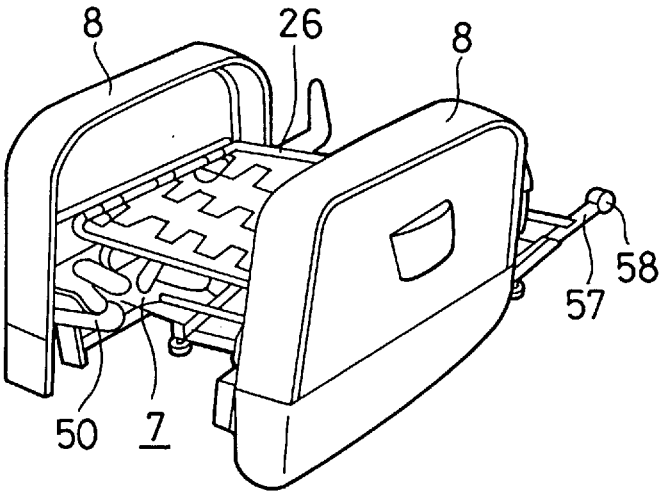

The link portions 50 of the reclining mechanisms 16, which move and turn the leg rest 4, are projected forwardly as shown in FIG. 20(*a*), and are retracted as shown in FIG. 20(*b*), and the link portions 50 in their forwardly-projected position cause the leg rest 4 to be extended outwardly in front of the seat 1. The link portions 50, when • in their forwardly-projected position, are exposed below the leg rest 5 as shown in FIG. 4, and therefore a child may have the finger caught by the exposed link portion 50. Therefore, as shown in FIG. 19(*b*), a link cover 51 is put on the outer one of the plurality of links constituting the link portion 50, and is secured thereto by screws or fastening elements of a synthetic resin, using holes 52*a* and 52*b*, thereby covering the link portion 50 constituted by the plurality of links. This arrangement prevents the finger from being caught by the link portion 50.

Figure 21:
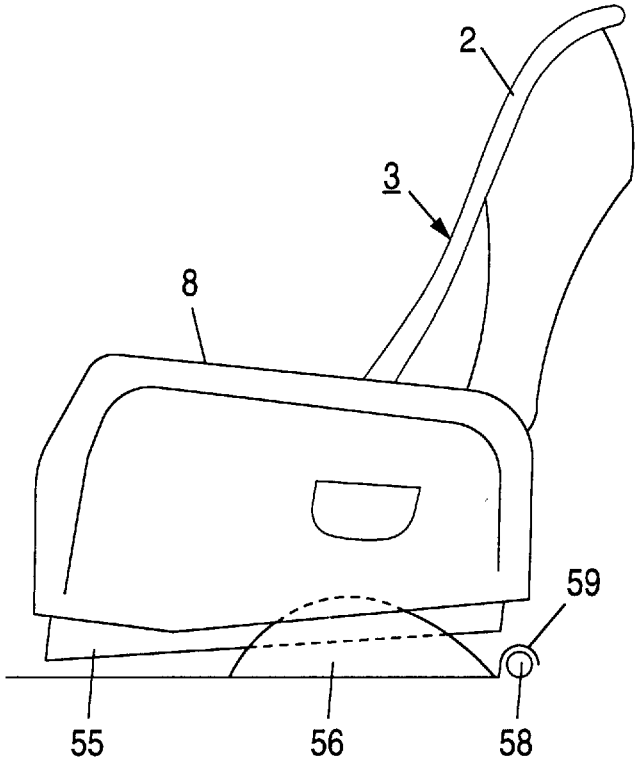
FIG. 21(*a*) is a side-elevational view of the massage machine used as a lounger.
Figure 21:
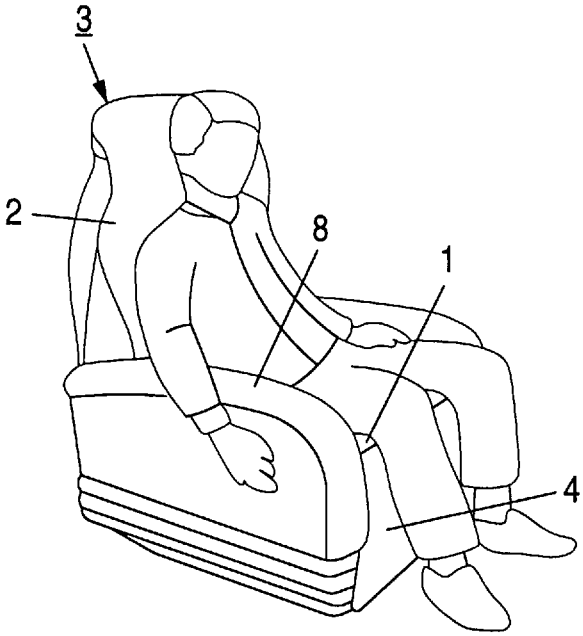
Figure 22:
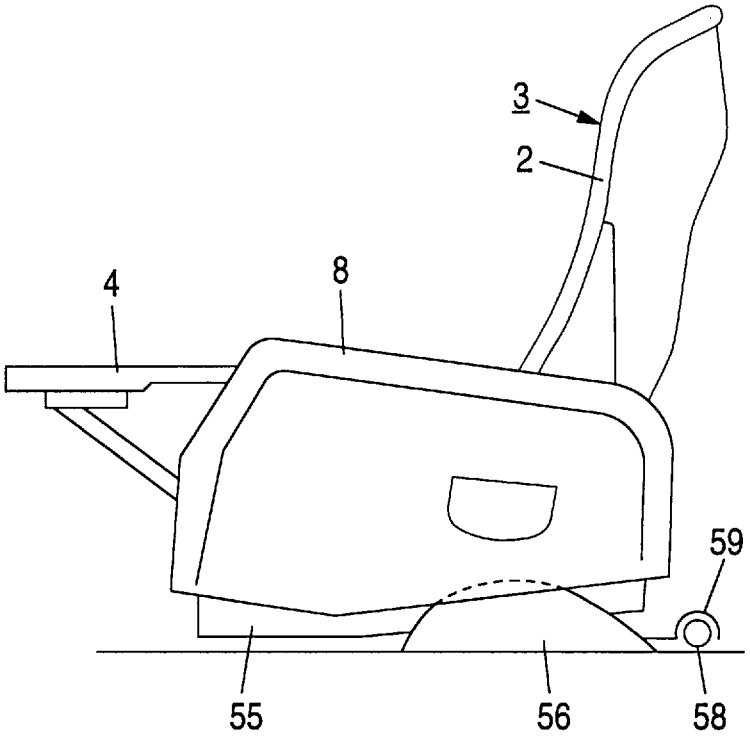
FIG. 22(*a*) is a side-elevational view of the massage machine, with the leg rest projected.
Figure 22:
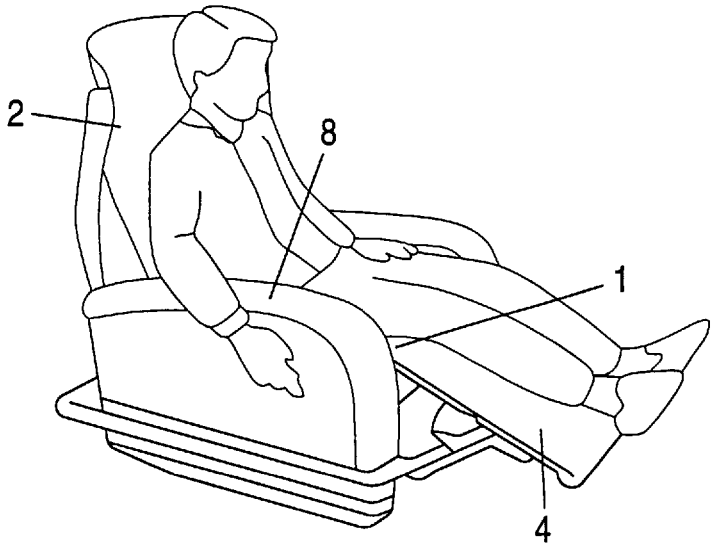
Figure 23:
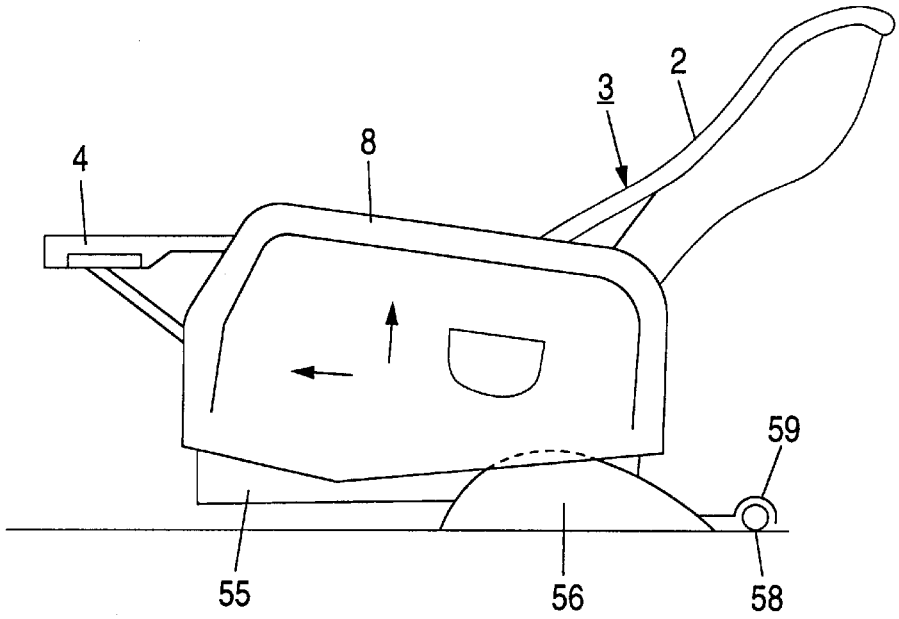
FIG. 23(*a*) is a front-elevational view of the massage machine, with the leg rest projected and with the back support laid down.
Figure 23:
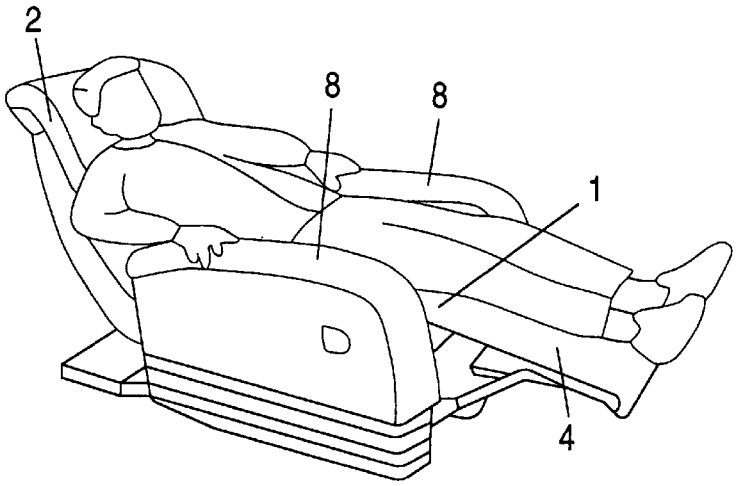
Figure 24:
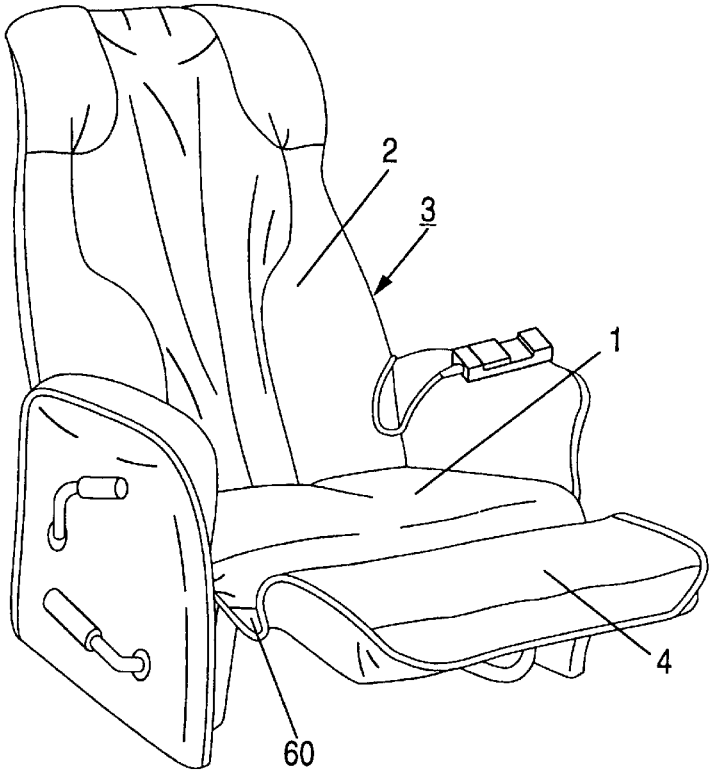
FIG. 24 PRIOR ART
FIG. 24 is a perspective view of a conventional massage machine with a leg rest projected, as seen from the front side.
Figure 25:
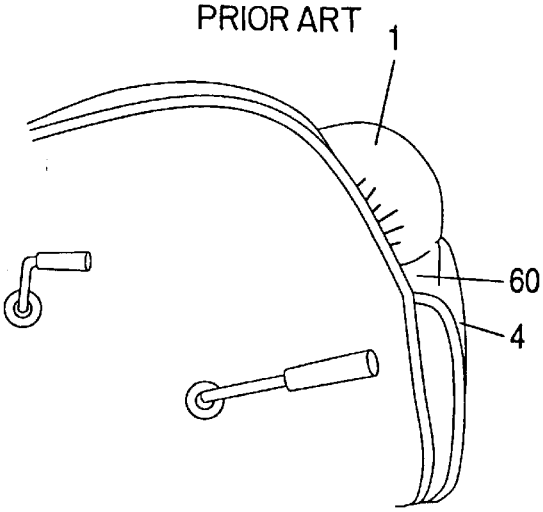
FIG. 25 PRIOR ART
FIG. 25 is a side-elevational view of the conventional massage machine, showing the leg rest in its retracted position.
Figure 26:
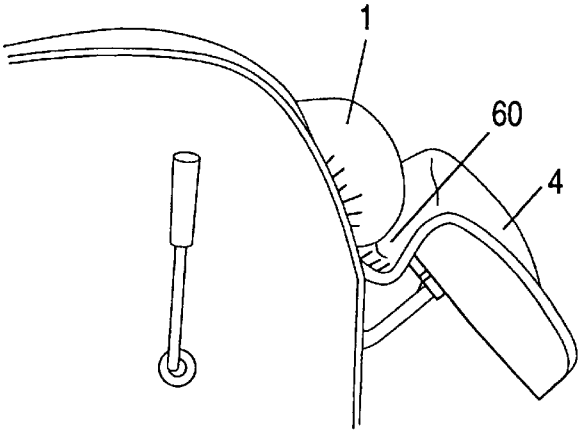
FIG. 26 PRIOR ART
FIG. 26 is a side-elevational view of the conventional massage machine, showing the process of moving the leg rest from the position of FIG. 25 to the position of FIG. 24.
Figure 27:
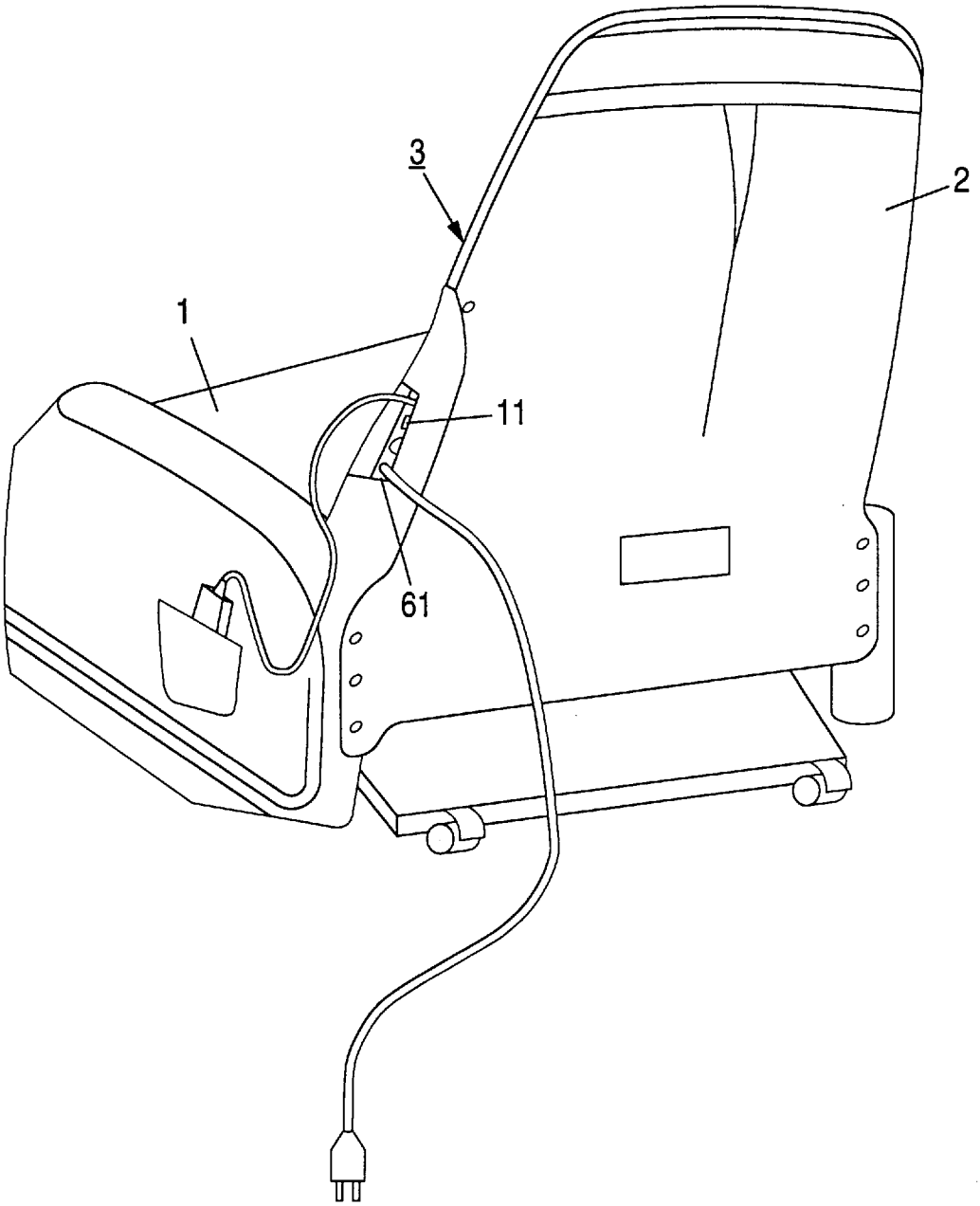
FIG. 27 PRIOR ART
FIG. 27 is a perspective view of the conventional massage machine as seen from the rear side.

FIGS. 21(*a*) to 23(*b*) show various conditions of use of the reclining-type, lounger-type massage machine 3. FIG. 21(*a*) and 21(*b*) show a condition in which the massage machine is used as a mere lounger in the normal condition. FIG. 22(*a*) and 22(*b*) show a condition in which the leg rest 4 is projected forwardly of the seat 1 50 that the leg rest 4 can be used by the user. FIG. 23(*a*) and 23(*b*) show a condition in which the leg rest 4 is projected forwardly of the seat 1, and also the back support 2 is laid down in a reclining condition. In the reclining-type, lounger-type massage machine 3 of this type, when the massage machine 3 is brought from the condition of FIG. 22(*a*) (in which the leg rest 4 is extended outwardly in front of the seat 1) into the condition of FIG. 23(*a*) (in which the leg rest 4 is extended outwardly in front of the seat 1, and also the back support 2 is laid down in the reclining condition), the seat 1 is slightly moved upward and forward as indicated by arrows in FIG. 23(*a*). The reason for this is that since the back support 2 is brought down, the lower portion of the back support 2 is raised, and therefore unless the seat 1 slightly moves upward, a step is formed between the lower portion of the back support 2 and the seat 1, 50 that the user can not be comfortably reclined on the lounger, and therefore the seat 1 is moved slightly upward in accordance with the falling of the back support 2. At the same time, when the back support 2 is turned down, the lower end of the back support 2 interferes with the seat 1, thus preventing the seat 1 from moving upward, and therefore the seat 1 is moved upward while slightly moved forward. The ability of the seat 1 to move upward and downward requires that the armrests 8, supporting the seat 1, be able to move upward and downward as well. Therefore, in this construction in which the armrests 8 move upward and downward, and also move forward and rearward as in the conventional construction, there is a possibility that the foot of a person, standing beside the lounger-type massage machine 3 will get caught in a space between the armrest 8 and the floor, and a possibility that a pet, such as a cat and a dog, which has crept into the space between the armrest 8 and the floor, will get caught in this space.

In the present invention, in order to overcome this problem, a safety cover 55 is secured to the lower portion of each armrest 8 as shown in FIGS. 21(*a*) to 23(*b*), thereby preventing the foot and a pet from being caught in the spaced between the armrest 8 and the floor. The safety cover 55 is made of a soft material such as a synthetic resin and rubber so that even if the foot is caught it will not be injured. The armrests 8 move upward and forward, so that part of the reclining device 7 is exposed, and therefore safety covers 56 are also attached to the reclining base 15 so as to cover such exposed portions, thereby preventing a child from putting the finger—or the hand into the reclining device 7 50 that the finger and the hand will not be injured.

Arms 57 extends rearwardly from a rear portion of the reclining base 15, and casters 58 are mounted on distal ends of the arms 57, respectively. There are provided caster covers 59 each covering the corresponding caster 58 and arm 57 from the upper side. For moving the lounger-type massage machine 3, the back support 2 is held by the hands, and the lounger-type massage machine 3 is angularly moved or turned about the casters 58, and then is moved by the hands holding the back support 2, with only the casters 58 held in contact with the floor. When the movement of the massage machine is finished, the reclining base 15 is again brought into contact with the floor.

As described above, in the lounger-type massage machine of the according to the present invention, the back support is reclinable relative to the seat, and there is provided the leg rest which is movable between the retracted position where the leg rest is retracted to be held below the seat and the projected position where the leg rest is extended outwardly in front of the seat, and the sheet is extended to cover the seat and the leg rest, and there is provided the looseness prevention mechanism which pulls the end of the sheet inwardly so as to prevent looseness of the sheet both in the retracted position and the projected position of the leg rest. With this construction, the gap between the leg rest and the seat is concealed by the sheet, and since the sheet is pulled by the looseness prevention mechanism, the seat and the leg rest appear to be integral with each other, with no separating line formed therebetween, both in the retracted position and the projected position of the leg rest. When the user has his legs extended over the leg rest extended outwardly, he feels relaxed since the sheet is not loose. When retracting the leg rest, the sheet does not need to be folded in contrast with the conventional construction, and the sheet is not thereby limited to a thin material, rather a thick material can be used as the sheet which gives an excellent appearance to the massage machine as a piece of furniture.

According to the present invention, the armrests are removably mounted on the reclining device, and the side plate is removably attached to the side of each of the armrests. With this construction, if the covering on the side plate on the outer side of the armrest is damaged, only the side plate is removed and the damaged covering can be replaced by a new one thus effecting the repair, and therefore, only the relevant portion can be repaired which is economical. In the maintenance and inspection. By removing the armrest, the internal mechanism can be easily exposed so that the maintenance and inspection can be effected. And besides, these parts can be divided into separate blocks, and each block of parts can be removably mounted and assembled, and by doing so, the assembly in the production line can be easily effected.

According to the present invention, the back cover can be attached to the back support, and the pads can be removably stored in the central portion of the back cover. With this arrangement, there can be selected one of the cases where the back cover is not used, where the back cover is attached to the back support, with no pad used, and where the back cover is attached to the back support, and one or more of the pads attached to the back cover. By doing so, a desired one of a strong massage and a soft massage can be easily selected. When this massage machine is used merely as a lounger, the contact of the arms and the massage balls with the body of the user can be weakened by attaching the back cover to the back support and by attaching the pads to the back cover. Therefore, the user can be seated on the lounger in a relaxed manner.

According to the present invention, the power switch for turning on and off the power source is provided at the lateral side portion of the rear side of the back support. With this construction, the power switch will not be inadvertently operated by the elbow of the user seated on the seat, and besides since the power switch does not need to be mounted in a narrow recess as in the conventional construction, the operability is enhanced.

What is claimed is:

1. A lounger-type massage machine comprising:

a seat;

a back support operative to be reclined relative to said seat;

a leg rest movable between a retracted position where said leg rest is retracted to a position below said seat and an extended position where said leg rest is extended outwardly in front of said seat;

a continuous sheet extended to cover said seat and said leg rest; and looseness prevention means having elastic members for elastically pulling an end of said sheet so as to prevent the loosening of said sheet in both said retracted position and said extended position of said leg rest.

2. A lounger-type massage machine according to claim 1, further comprising:

armrests removably mounted on a reclining device provided with said seat; and a side plate removably attached to a side of each of said armrests.

3. A lounger-type massage machine according to claim 1, further comprising:

a back cover detachably attached to said back support; and pads removably stored in a central portion of said back cover.

4. A lounger-type massage machine according to claim 1, wherein said back support has a front side facing said seat and a rear side opposite said front side of said back support; and further comprising a power switch for turning on and off a power source, said power switch provided at a side portion of said rear side of said back support.

5. A lounger-type massage machine according to claim 1, further comprising:

an engaging member for engaging a distal end of said looseness prevention means with a lower surface or said leg rest.

6. A lounger-type massage machine comprising:

a seat;

a back support reclinable relative to said seat;

a leg rest movable between a retracted position where said leg rest is retracted to a position below said seat and an extended position where said leg rest is projected forwardly of said seat;

a sheet extended to cover said seat and said leg rest;

an armrest having a side plate removably attached to a side of said armrest; and a reclining device located under said seat so that said seat, said back support, said leg rest, and said armrest are detachably mounted on said reclining device.

7. A lounger-type massage machine according to claim 6, further comprising:

looseness prevention means for pulling an end of said sheet inwardly so as to prevent loosening of said sheet in both said retracted position and said projected position of said leg rest.

8. A lounger-type massage machine according to claim 6, further comprising:

a back cover detachably attached to said back support; and pads removably stored in a central portion of said back cover.

9. A lounger-type massage machine according to claim 6, wherein said back support has a front side facing said seat and a rear side opposite said front side of said back support; and further comprising a power switch for turning on and off a power source, said power switch provided at a side portion of said rear side of said back support.

10. A lounger-type massage machine according to claim 6, further comprising:

an engaging member for engaging a distal end of said looseness prevention means with a lower surface of said leg rest.

11. A lounger-type massage machine comprising:

a seat;

a back support operative to be reclined relative to said seat;

a leg rest movable between a retracted position where said leg rest is retracted to a position below said seat and a projected position where said leg rest is projected forwardly of said seat;

a sheet extended to cover said seat and said leg rest;

looseness prevention means for pulling an end of said sheet inwardly so as to prevent the loosening of said sheet in both said retracted position and said projected position of said leg rest;

armrests removably mounted on a reclining device provided with said seat; and a side plate removably attached to a side of each of said armrests.

12. A lounger-type massage machine comprising:

a seat;

a back support operative to be reclined relative to said seat;

a leg rest movable between a retracted position where said leg rest is retracted to a position below said seat and an extended position where said leg rest is extended outwardly in front of said seat;

a continuous sheet extended to cover said seat and said leg rest; and elastic members which elastically pull an end of said sheet so as to prevent the loosening of said sheet in both said retracted position and said extended position of said leg rest.

13. A lounger-type massage machine comprising:

a seat;

a back support operative to be reclined relative to said seat;

a leg rest movable between a retracted position where said leg rest is retracted to a position below said seat and an extended position where said leg rest is extended outwardly in front of said seat;

a continuous cushion extended to cover said seat and said leg rest; and looseness prevention means having elastic members for elastically pulling an end of said cushion so as to prevent the loosening of said cushion in both said retracted position and said extended position of said leg rest.

14. A lounger-type massage machine comprising:

a seat;

a back support operative to be reclined relative to said seat;

a leg rest movable between a retracted position where said leg rest is retracted to a position below said seat and an extended position where said leg rest is extended outwardly in front of said seat;

a continuous cushion extended to cover said seat and said leg rest; and elastic members which elastically pull an end of said cushion so as to prevent the loosening of said cushion in both said retracted position and said extended position of said leg rest.

* * * * *